US006079755A

United States Patent [19]

Chang

[11] Patent Number: 6,079,755

[45] Date of Patent: Jun. 27, 2000

[54] ELECTROMAGNETIC LOCK DEVICE

[76] Inventor: Chih Chung Chang, 6F., No. 440-2, Gin Pin Road, Chong Ho City, Taipei Hsien, Taiwan

[21] Appl. No.: 09/327,000

[22] Filed: Jun. 7, 1999

[51] Int. Cl.[7] ..... E05C 1/06

[52] U.S. Cl. ..... 292/144; 292/251.5

[58] Field of Search ..... 292/144, 201, 292/251.5; 70/277, 280

[56] References Cited

U.S. PATENT DOCUMENTS

| | | | |
|---|---|---|---|
| 2,798,751 | 7/1957 | Walden | 292/144 |
| 3,901,542 | 8/1975 | Salzman | 292/144 |
| 4,909,053 | 3/1990 | Zipf | 70/283 |
| 5,044,678 | 9/1991 | Detweiler | 292/144 |
| 5,386,713 | 2/1995 | Wilson | 70/280 |
| 5,531,086 | 7/1996 | Bryant | 70/279 |

*Primary Examiner*—B. Dayoan
*Assistant Examiner*—Gary Estremsky

[57] ABSTRACT

An electromagnetic lock device includes a latch slidably received in a housing, and a follower rotatably secured in the housing and having an arm engaged with the latch and having one or more pegs. A spindle is slidably engaged in and actuated by the coil and coupled to either of the pegs by a link for rotating the follower in either of the directions to actuate the latch. The latch may be prevented from rotating relative to the housing. A casing is secured in the housing for receiving the coil. A spring may be used to bias the spindle toward the follower.

12 Claims, 11 Drawing Sheets

ELECTROMAGNETIC LOCK DEVICE

BACKGROUND OF THE INVENTION

1. Field of the Invention

The present invention relates to a lock, and more particularly to an electromagnetic lock device.

2. Description of the Prior Art

Typical electromagnetic lock devices comprise a spindle slidably received in an electromagnetic member, such as engaged in a coil of the electromagnetic member so as to be moved by the electromagnetic member. The spindle of some of the lock devices are directly used to latch the doors or the like. The other lock devices include a latch directly moved by the spindle so as to lock the doors or the like. The typical electromagnetic lock devices may not be effectively operated.

The present invention has arisen to mitigate and/or obviate the afore-described disadvantages of the conventional electromagnetic lock devices.

SUMMARY OF THE INVENTION

The primary objective of the present invention is to provide an electromagnetic lock device which includes a latch indirectly coupled to and actuated by the electromagnetic device.

The other objective of the present invention is to provide an electromagnetic lock device which includes a latch having an actuation direction that may be changed and selectively actuated by the electromagnetic device.

In accordance with one aspect of the invention, there is provided an electromagnetic lock device comprising a housing, a latch slidably received in the housing, a follower rotatably secured to the housing at a pivot pin, the follower including an arm extended therefrom and engaged with the latch for moving the latch inward and outward of the housing, the follower including a first peg extended therefrom, an electromagnetic member secured in the housing and including a coil, a spindle slidably engaged in and actuated by the coil, means for coupling the spindle to the first peg of the follower. The spindle may be actuated to move along the coil in either of the direction by the coil when the coil is energized. The follower is rotated in a first direction, by the spindle, to move the latch inward of the housing and is rotated in a reverse direction to move the latch outward of the housing.

The latch includes a bore formed therein, the housing includes a pole extended therefrom and engaged into the bore of the latch for guiding the latch to move along the pole. The housing includes a block secured thereto, the pole is extended from the block.

The latch includes a recess formed therein for receiving the arm of the follower and for allowing the arm of the follower to move the latch inward and outward of the housing. The recess of the latch may be an annular recess. The arm of the follower includes a head formed thereon and engaged in the recess of the latch.

A guiding means is further provided for guiding the latch to move relative to the housing and includes a first flat surface formed in the latch, a cover secured to the housing and having a second flat surface formed therein and engaged with the first flat surface of the latch, the latch is prevented from rotating relative to the housing and the cover by the engagement between the first flat surface of the latch and the second flat surface of the cover.

The follower further includes a second peg extended therefrom, the coupling means couples the spindle to the second peg of the follower for allowing the follower to be rotated in the first direction to move the latch outward of the housing and to be rotated in the reverse direction to move the latch inward of the housing. The coupling means includes a link having a first end pivotally coupled to the spindle at a pivot axle and having a second end pivotally coupled to the first peg.

The spindle includes an extension extended therefrom. A casing is further secured in the housing for receiving the coil. The extension of the spindle includes a size smaller than that of the spindle, the casing includes a puncture formed therein for slidably receiving the spindle and includes an aperture formed therein for slidably receiving the extension of the spindle, the aperture of the casing includes a size smaller than that of the puncture of the casing.

A spring biasing device is further provided for biasing said spindle toward said follower and to rotate said follower and thus to actuate the latch.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
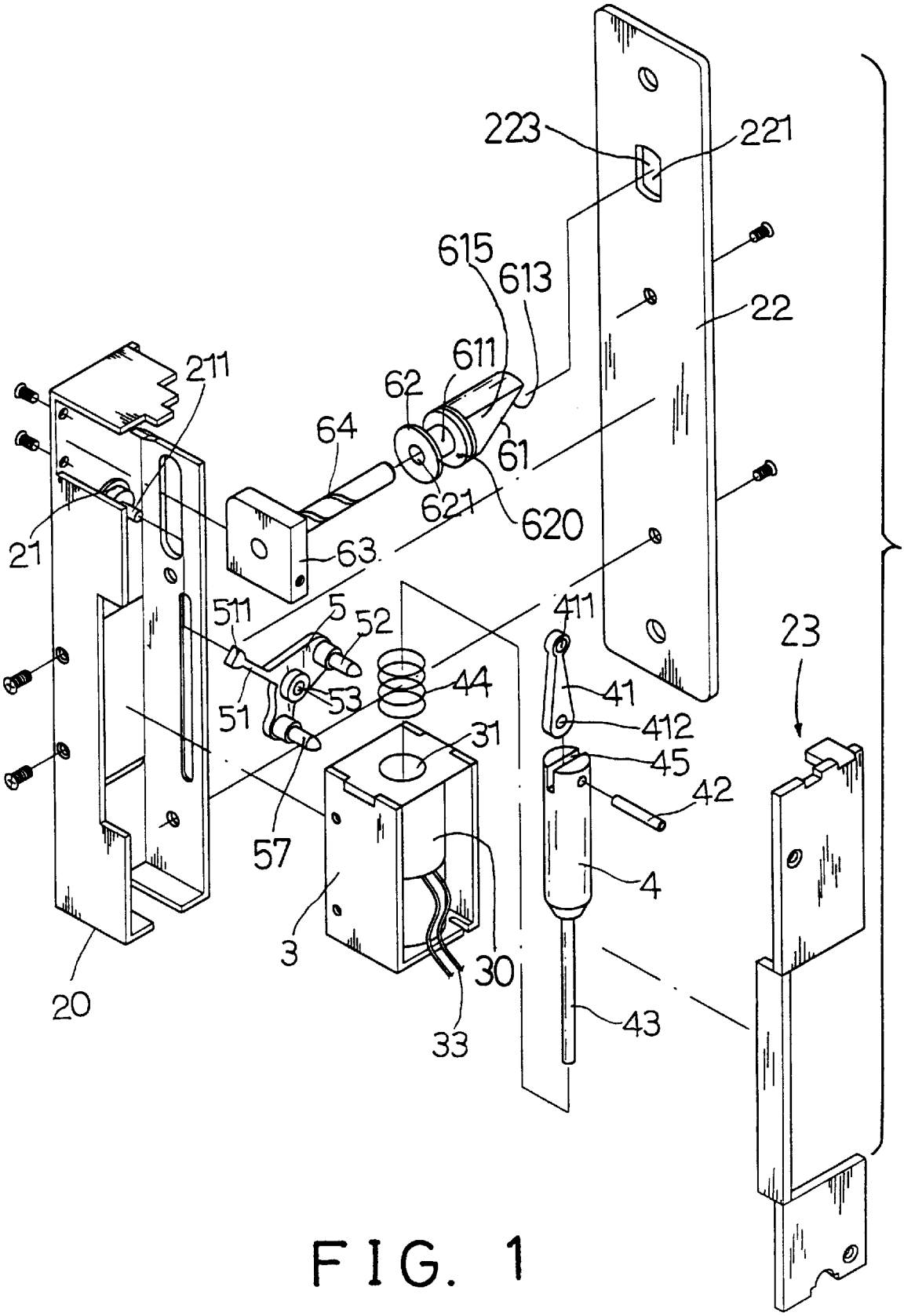
FIG. 1 is an exploded view of an electromagnetic lock device in accordance with the present invention.
Figure 2:
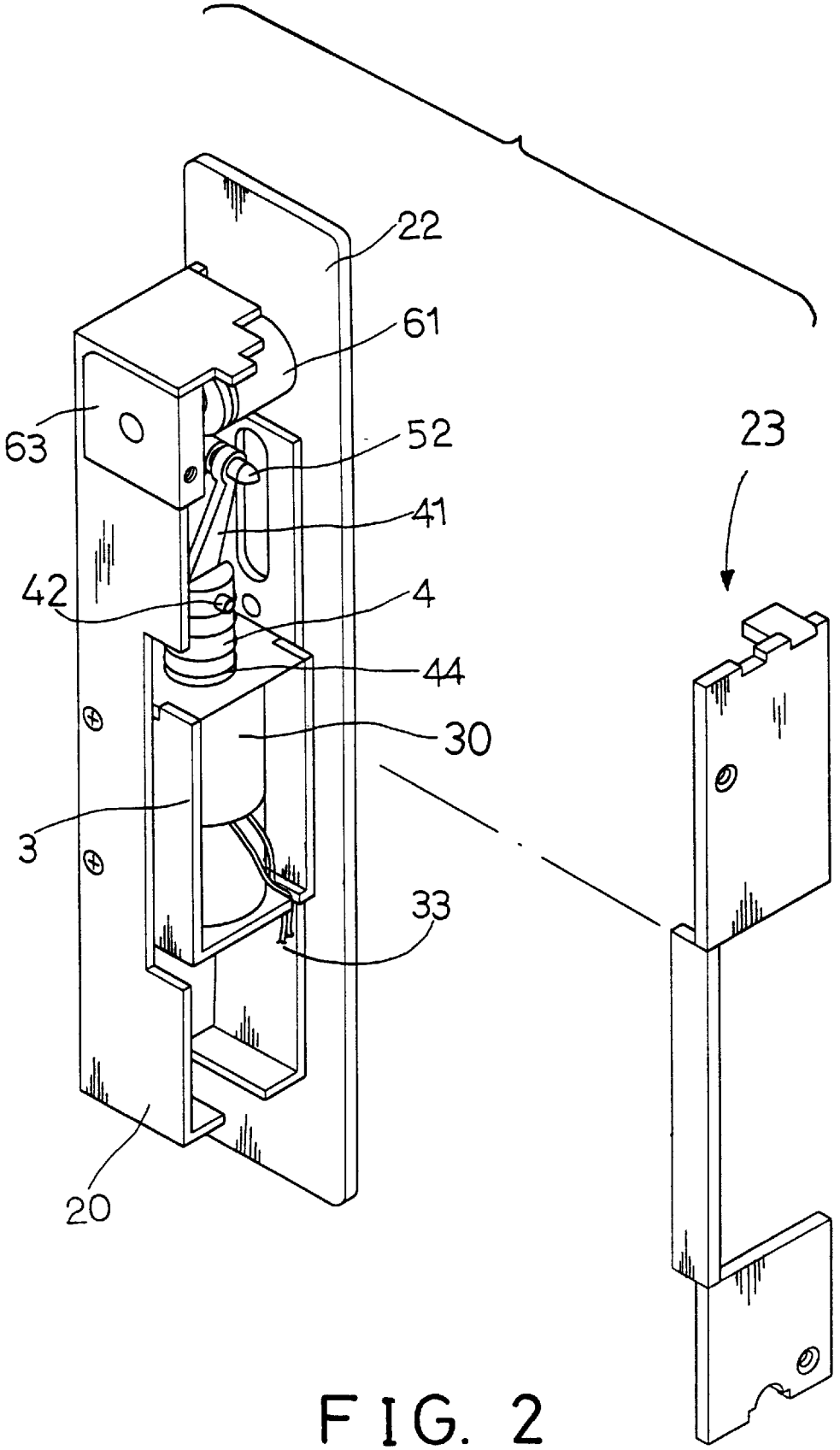
FIG. 2 is a partial exploded view of the electromagnetic lock device.
Figure 3:
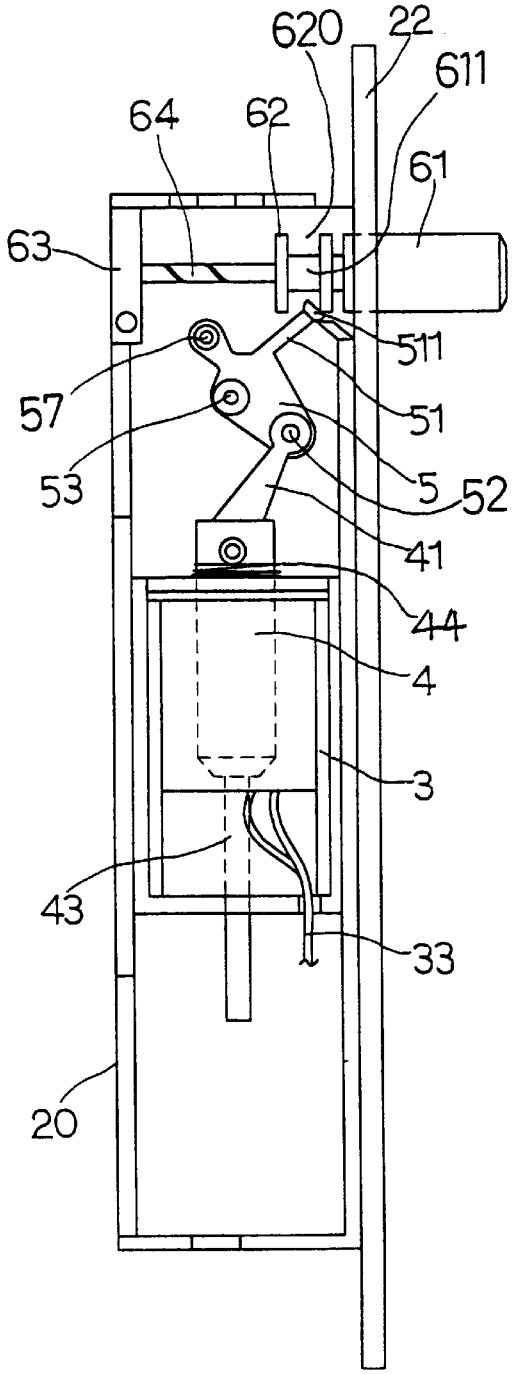

Referring to the drawings, and initially to FIGS. 1–3, an electromagnetic lock device in accordance with the present invention comprises a housing 20 including a seat 21 having a pin 211 extended therefrom and including a cap 23 detachably secured to the side portion thereof for enclosing the housing 20 and for retaining the elements within the housing 20. A cover 22 is detachably secured to the front portion of the housing 20 and includes an orifice 221 formed therein for slidably receiving a latch 61 therein. A block 63 is secured to the housing 20 and includes a pole 64 laterally extended therefrom and preferably perpendicular to the longitudinal axis of the housing 20. Alternatively, the pole 64 may be directly secured to or extended from the housing 20 instead of being extended from the block 63. The latch 61 includes a bore 621 formed therein for slidably receiving the pole 64 and for allowing the latch 61 to be moved along the pole 64. Alternatively, the latch 61 may also be slidably received in the housing 20 by the other guiding tracks or guiding channels or the like instead of the pole 64. The latch 61 includes a cavity or an annular recess 620 formed therein and defined by an end stop 62; or includes a stud 611 of a reduced size extended therefrom and the end stop 62 secured to the free end of the stud 611 for defining the cavity or the annular recess 620.

A follower 5 includes a hole 53 formed therein for receiving the pin 211 of the housing 20 and for allowing the follower 5 to be rotatably or pivotally secured to the housing 20 at the pivot pin 211. The follower 5 includes one or more pegs 52, 57 and an arm 51 extended therefrom. The arm 51 preferably includes a head 511 formed on the free end thereof and engaged into the recess 620 of the latch 61 for moving the latch 61 inward and outward of the housing 20 when the follower 5 is rotated. As shown in the drawings, it is preferable that two pegs 52, 57 are provided and extended from the follower 5 and are spaced away from each other and are spaced from the pivot pin 211 or the hole 53 of the follower 5. The arm 51 is located between the pegs 52, 57 and extended away from the pegs 52, 57. Or, the arm 51 and the pegs 52, 57 form a triangle.

A casing 3 is secured in the housing 20 and includes a coil 30 of an electromagnetic member therein and includes a puncture 31 formed in the upper portion thereof for slidably receiving a spindle 4 therein and includes an aperture 32 formed in the lower portion thereof for slidably receiving an extension 43 that is extended from the spindle 4 and that includes a size smaller than that of the spindle 4. The aperture 32 includes a size smaller than that of the puncture 31 of the casing 3 for slidably receiving the extension 43 of the spindle 4 of the corresponding reduced size. The spindle 4 and/or the extension 43 of the spindle 4 are slidably engaged in the coil 30 which is coupled to an electric power supply by electric wires 33. The spindle 4 may be moved along a longitudinal direction by the coil 30 when the coil 30 is energized. The spindle 4 includes a slot 45 formed in the upper portion thereof. A link 41 includes a lower portion 412 received in the slot 45 of the spindle 4 and pivotally secured to the spindle 4 at a pivot axle 42 and includes an upper portion 411 that may be selectively coupled to either of the pegs 52, 57 of the follower 5 (FIGS. 3–6). The pivot axle 42 preferably includes two ends extended outward of the spindle 4. A spring 44 is engaged on the spindle 4 and engaged between the pivot axle 42 and the casing 3 for moving the spindle 4 upward when the coil 30 has not been energized. Alternatively, without the spring 44, the spindle 4 may also be actuated upward and downward by the coil 30.

Figure 4:
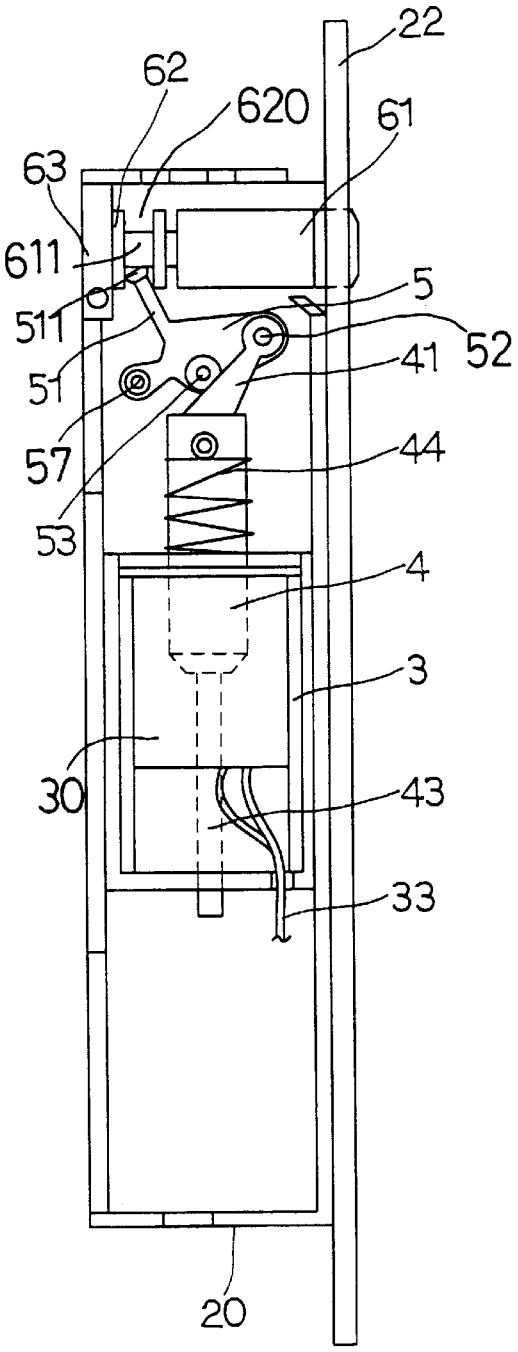
FIGS. 3, 4, 5, 6 are plane schematic views illustrating the operation of the electromagnetic lock device.
Figure 7:
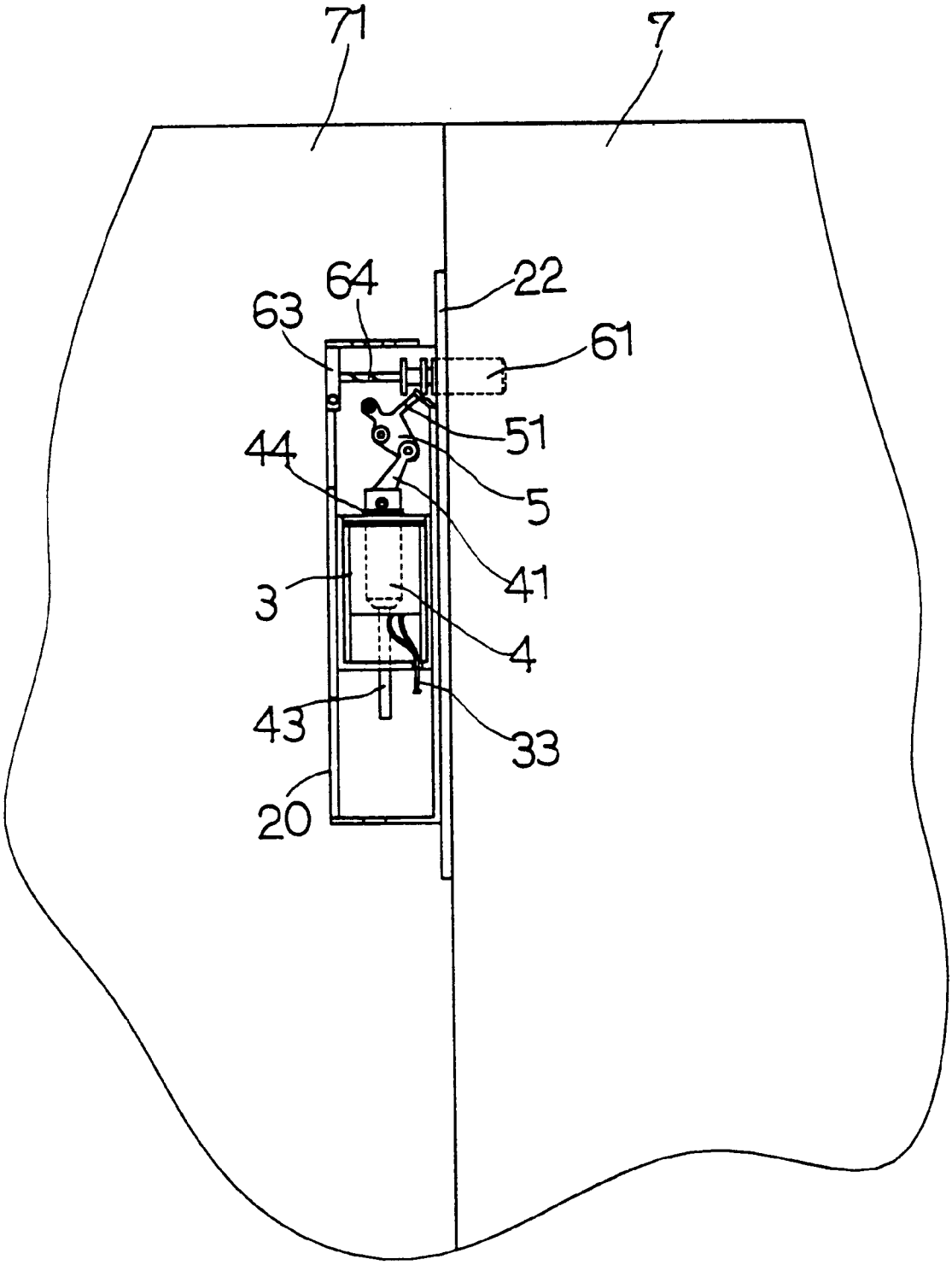
FIG. 7 is a plane schematic view illustrating the attachment of the electromagnetic lock device to a door.

In operation, as shown in FIG. 4, when the upper portion 411 of the link 41 is coupled to the peg 52 of the follower 5, for example, the latch 61 may be moved inward of the housing 20 by the arm 51 of the follower 5 when the spindle 4 is biased upward by the spring 44 and when the coil 30 has not been energized. As shown in FIG. 3, when the coil 30 is energized to move the spindle 4 downward against the spring 44, the latch 61 may be moved outward of the housing 20 to lock the door 7 panel (FIG. 7) by the arm 51 of the follower 5 when the follower 5 is rotated clockwise by the spindle 4. The follower 5 may be rotated counterclockwise when the spring 44 bias the spindle 4 upward. The housing 20 may be secured in a door frame 71, and the latch 61 may be engaged into a lock hole that is formed in the door panel 7.

Figure 5:
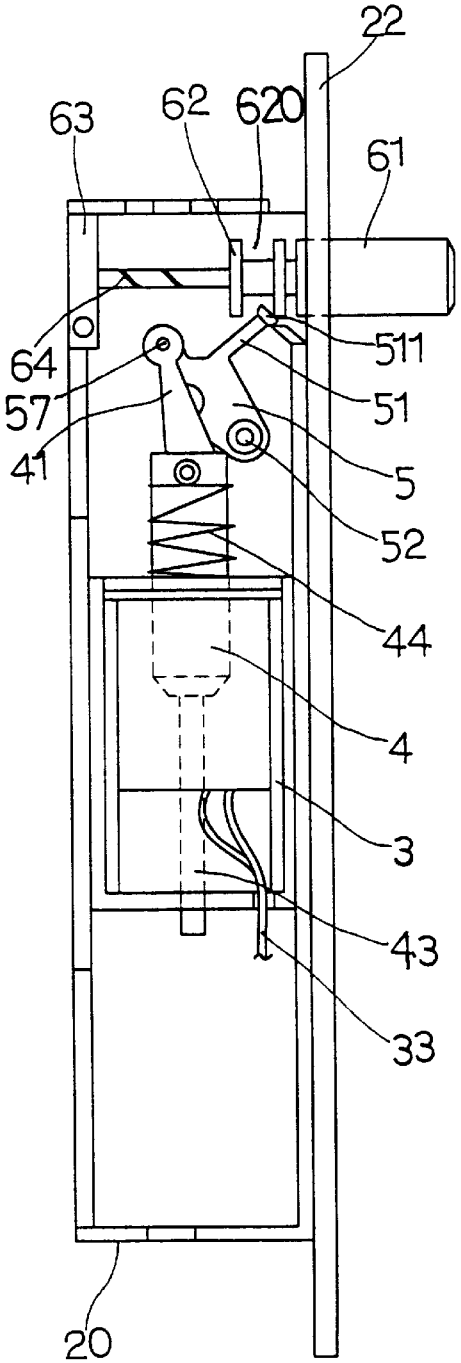
Figure 6:
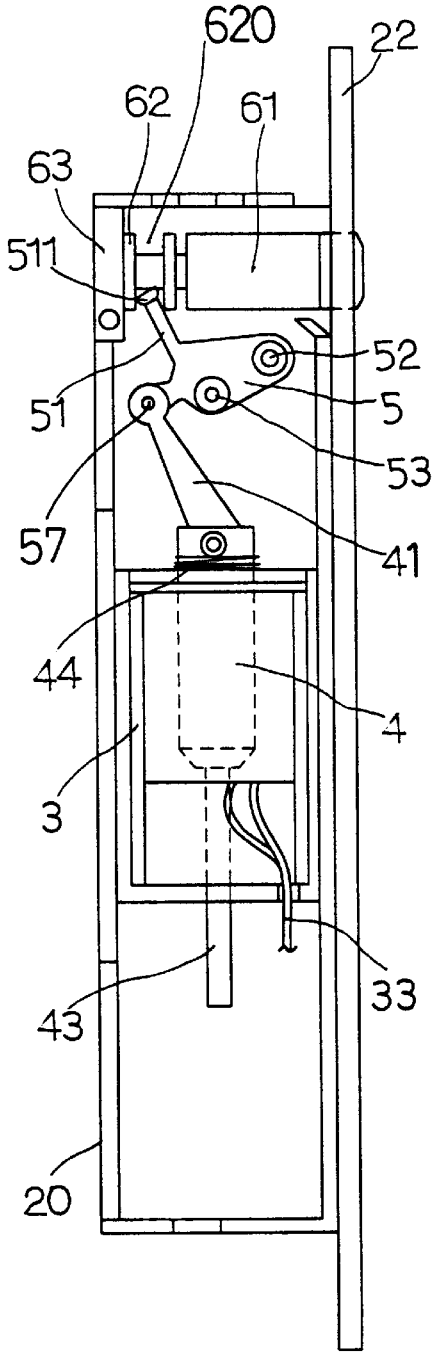

As shown in FIG. 5, alternatively, when the upper portion 411 of the link 41 is coupled to the other peg 57 of the follower 5, the latch 61 may be moved outward of the housing 20 to lock the door panel by the arm 51 of the follower 5 when the spindle 4 is biased upward by the spring 44 and when the coil 30 has not been energized. As shown in FIG. 6, when the coil 30 is energized to move the spindle 4 downward against the spring 44, the latch 61 may be moved inward of the housing 20 when the follower 5 is rotated in a reverse direction (counterclockwise) by the spindle 4. The follower 5 may be rotated clockwise when the spring 44 bias the spindle 4 upward. The spaced distance between the pegs 52, 57 and the pin 211 may be adjusted for adjusting the force applying onto the arm of the follower.

Figure 8:
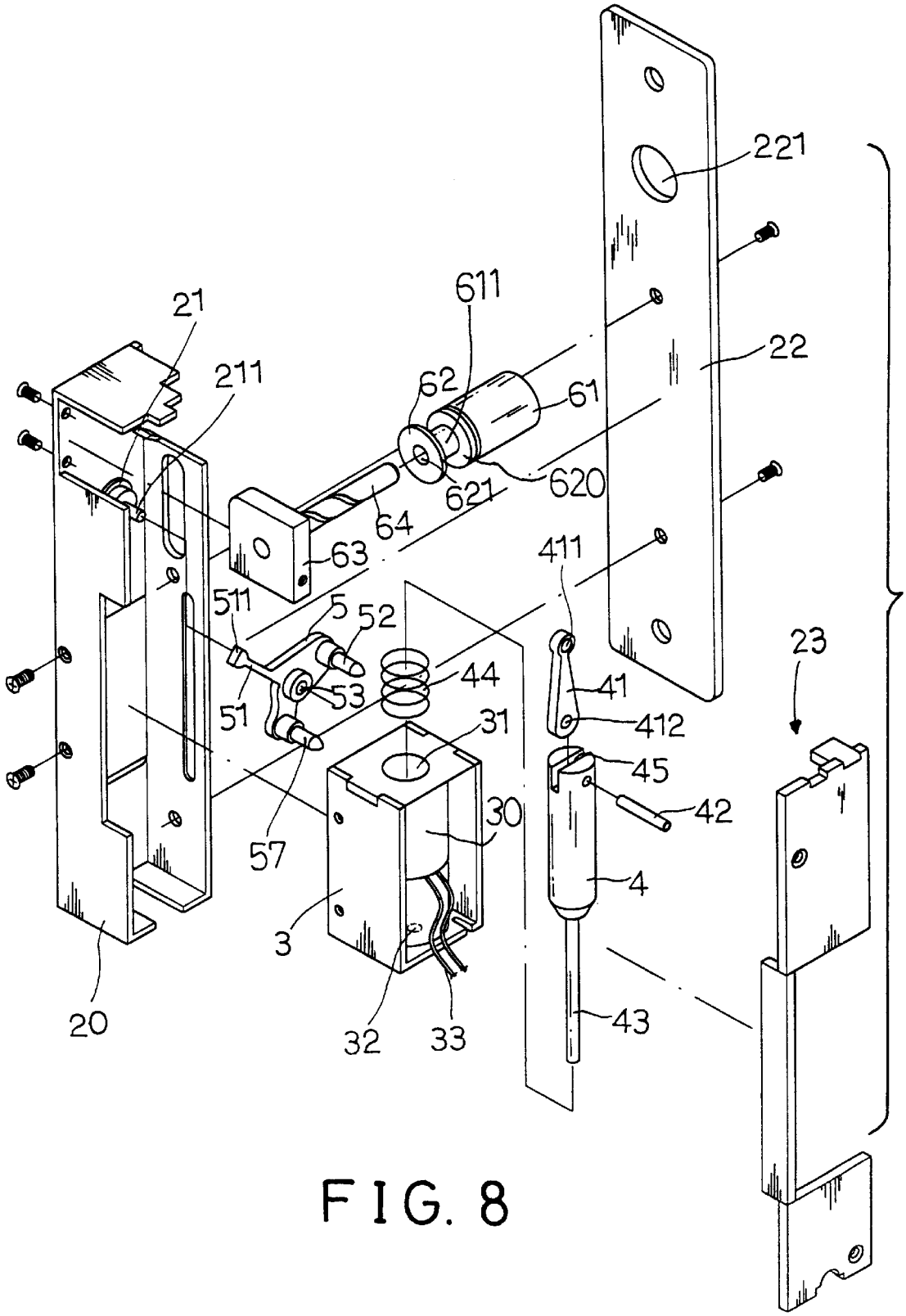
FIG. 8 is an exploded view illustrating the other embodiment of the electromagnetic lock device.
Figure 9:
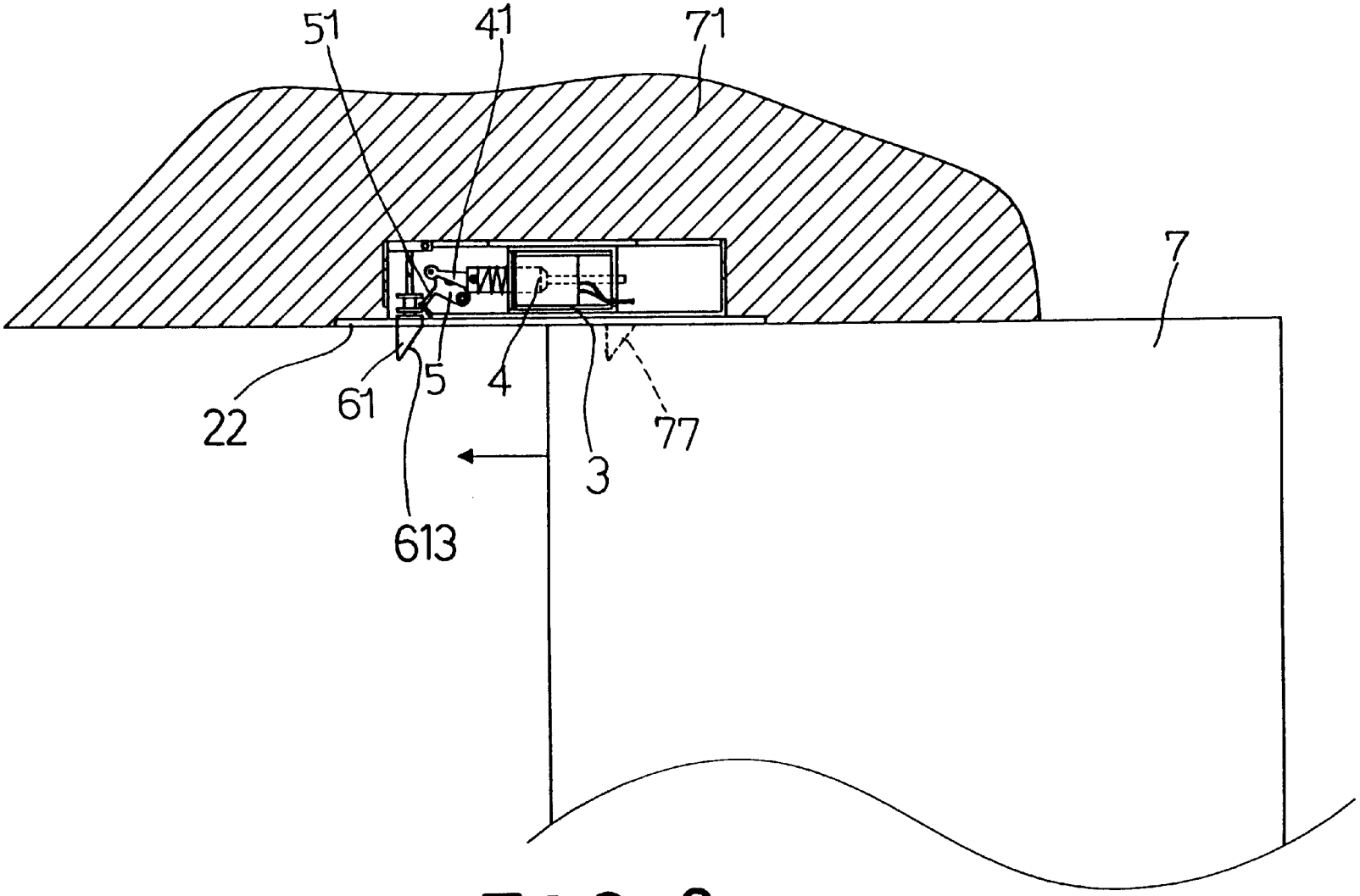
FIGS. 9, 10, 11 are schematic views illustrating the operation of the electromagnetic lock device.
Figure 10:
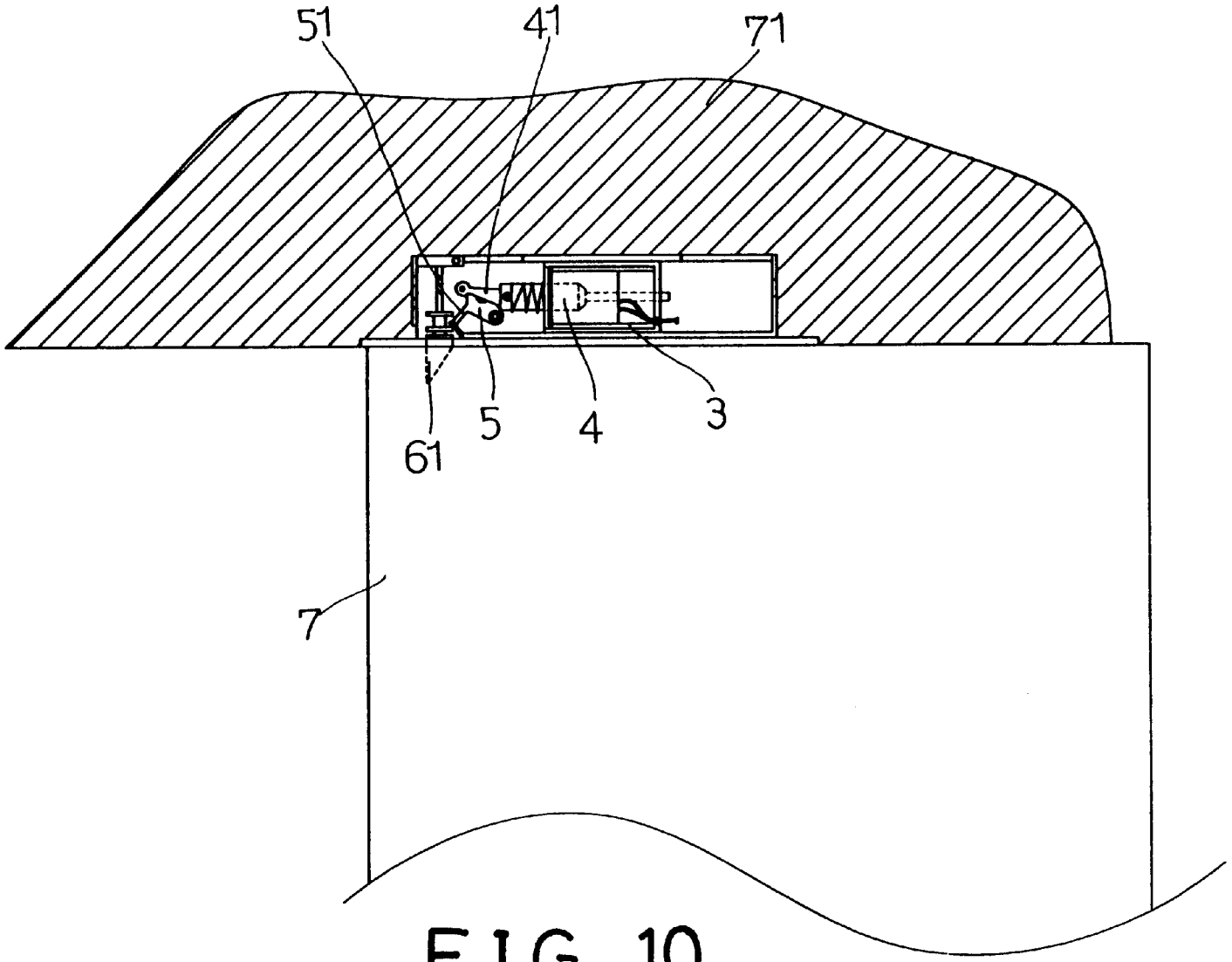

The latch 61 may include a tapered surface 613 formed therein and may include one or more flat surfaces 615 formed in the side portions. Alternatively, the latch 61 may include a cylindrical shape as shown in FIG. 8. The orifice 221 of the cover 22 may include one or more corresponding flat surfaces 223 formed therein for engaging with the flat surfaces 615 of the latch 61 and for preventing the latch 61 from rotating relative to the housing 20 and the cover 22, and for directing the moving direction of the latch 61. As shown in FIGS. 9 and 10, when the latch 61 is biased outward of the housing 20 by the spring 44, the door panel 7 may be moved leftward to engage with the tapered surface 613 (FIG. 9) of the latch 61 to move the latch 61 inward of the housing 20 until the latch 61 is biased to engage with the lock hole 77 of the door panel 7. Alternatively, as shown in FIG. 11, the position of the housing 20 may be changed to change the direction of the latch 61, such that the door panel 7 may engage with the tapered surface 613 of the latch 61 and may move the latch 61 inward of the housing 20 when the door panel 7 is moved rightward.

Figure 11:
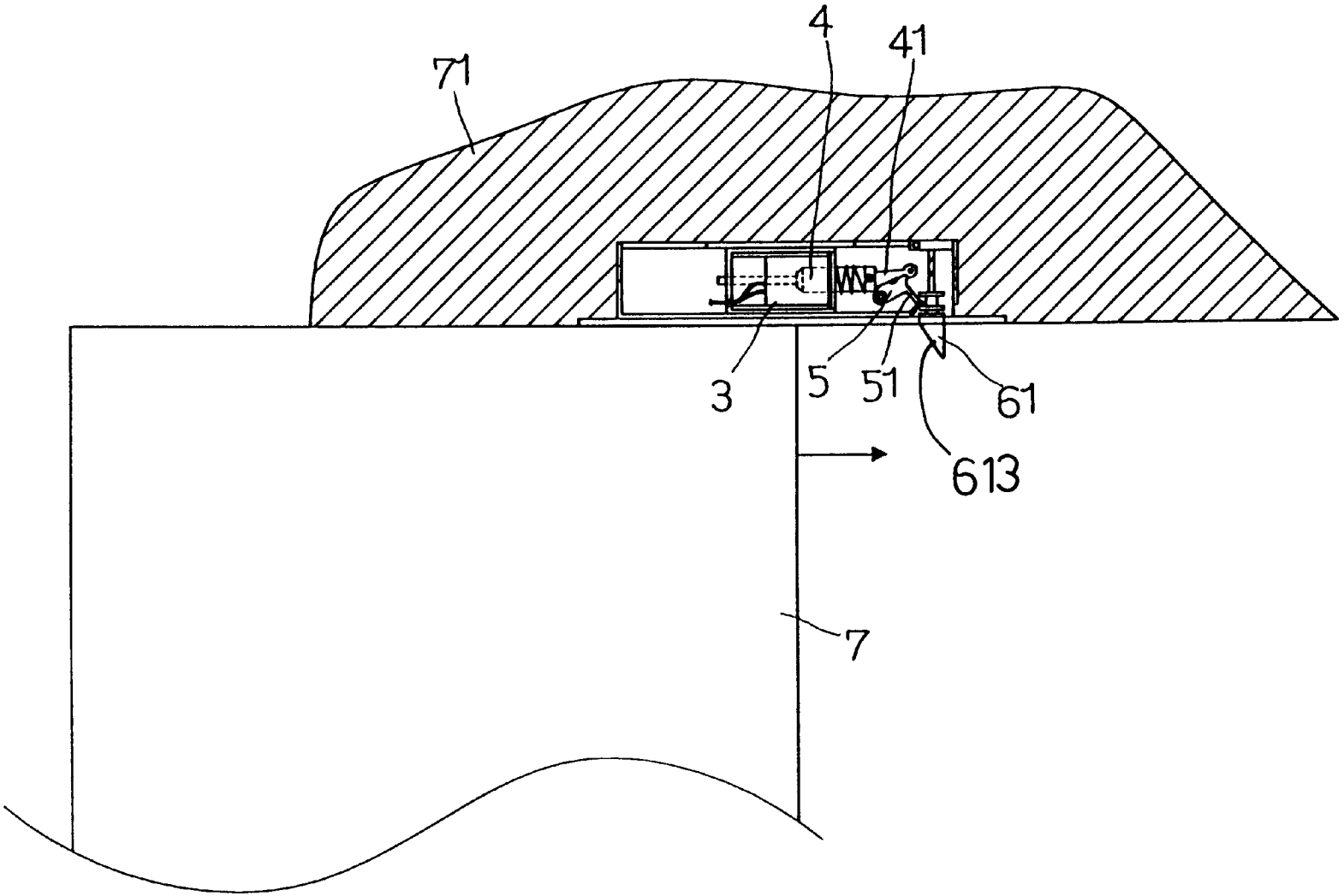
Figure 14:
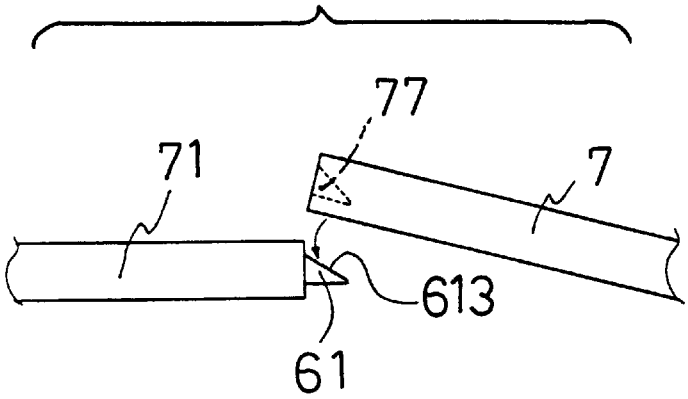
FIGS. 14, 15 are top schematic views illustrating the operation of the electromagnetic lock device respectively.
Figure 12:
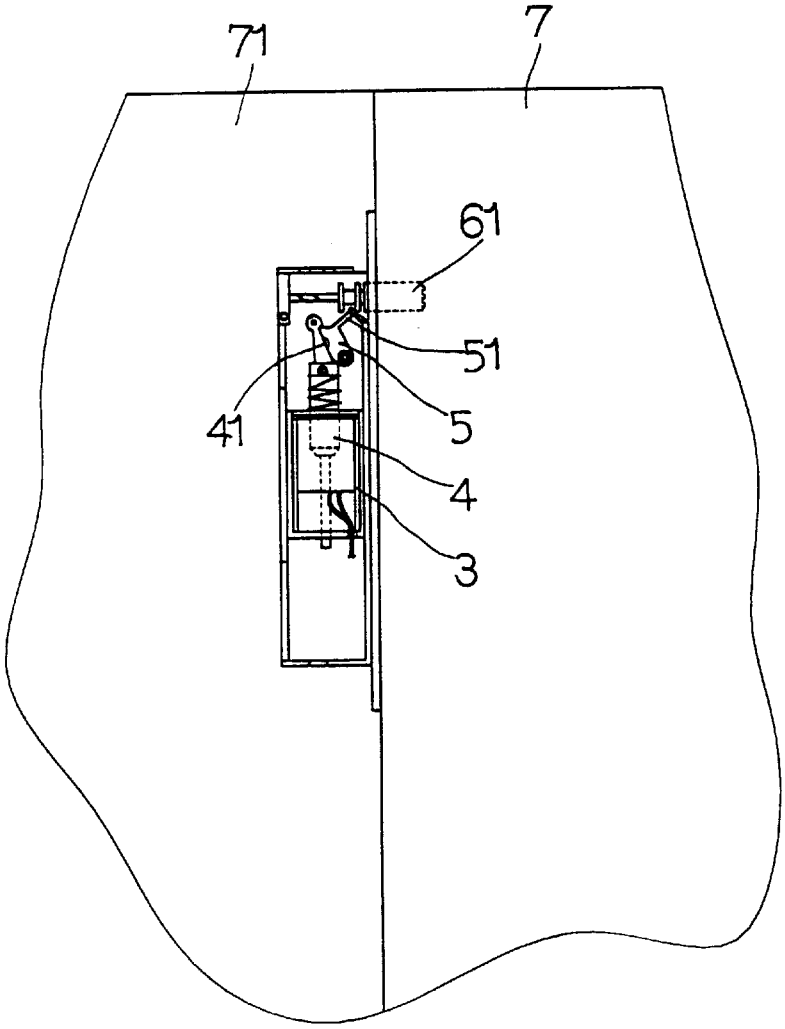
FIGS. 12, 13 are plane schematic views illustrating the other applications of the electromagnetic lock device.
Figure 15:
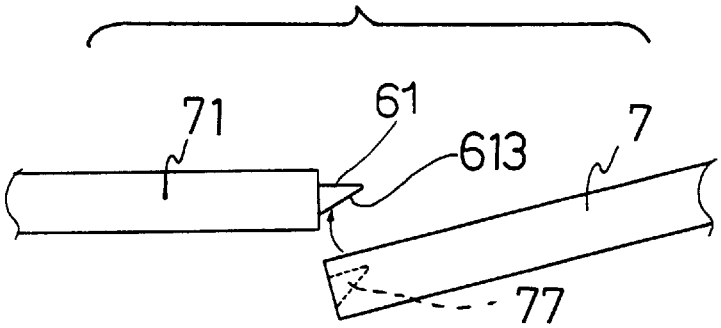
Figure 13:
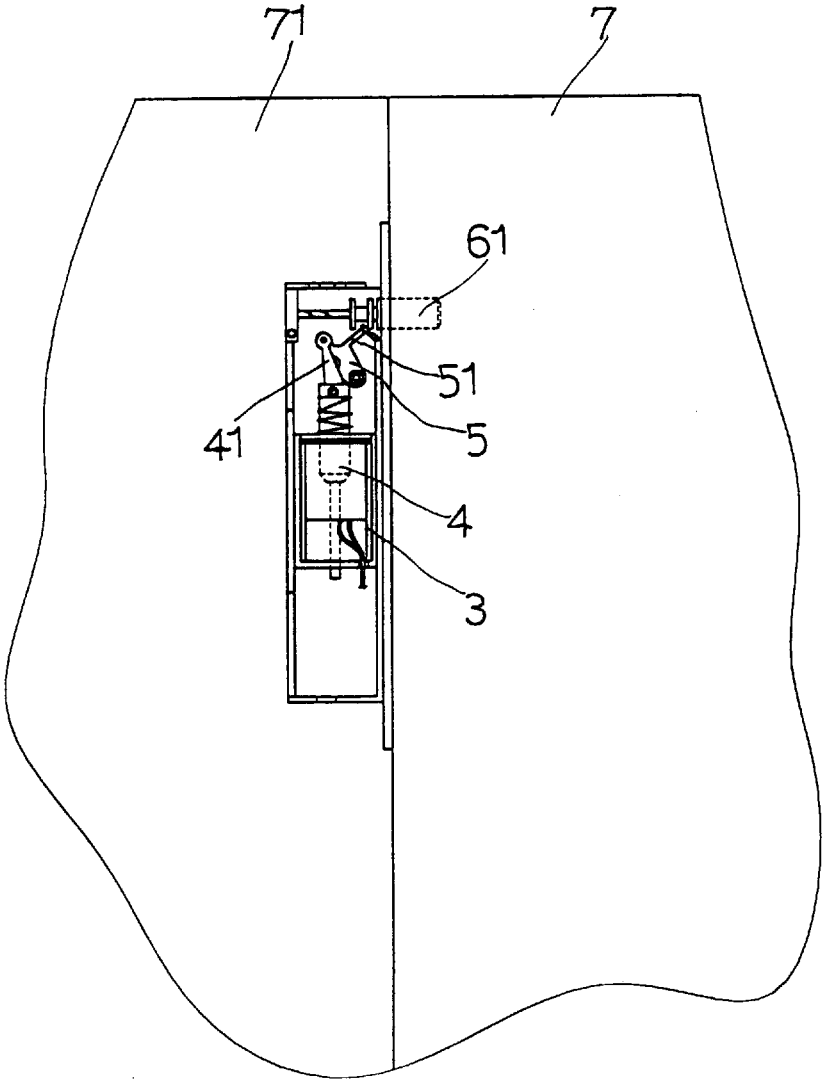

Referring next to FIGS. 12–15, the housing of the electromagnetic lock device may also be disposed between the door frame 71 and the door panel 7 in a direction different from that shown in FIGS. 9–11. The door panel 7 may also engage with the tapered surface 613 of the latch 61 and may move the latch 61 inward of the housing 20 when the door panel 7 is moved inward (FIGS. 12, 14 from outside of the building) or may move the latch 61 inward of the housing 20 when the door panel 7 is moved outward (FIGS. 13, 15 from inside of the building).

Accordingly, the electromagnetic lock device in accordance with the present invention includes a latch 1indirectly coupled to and actuated by the electromagnetic device. In addition, the actuation direction of the latch may be changed and selectively actuated by the electromagnetic device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electromagnetic lock device comprising:

a housing including a pole extended therefrom, a latch slidably received in said housing, said latch including a bore formed therein for slidably receiving said pole of said housing and for guiding said latch to move along said pole, a follower rotatably secured to said housing at a pivot pin, said follower including an arm extended therefrom and engaged with said latch for moving said latch inward and outward of said housing, said follower including a first peg extended therefrom, an electromagnetic member secured in said housing and including a coil, a spindle slidably engaged in and actuated by said coil, means for coupling said spindle to said first peg of said follower, said follower being rotated in a first direction to move said latch inward of said housing and being rotated in a reverse direction to move said latch outward of said housing.

2. The electromagnetic lock device according to claim 1, wherein said housing includes a block secured thereto, said pole is extended from said block.

3. The electromagnetic lock device according to claim 1, wherein said latch includes a recess formed therein for receiving said arm of said follower and for allowing said arm of said follower to move said latch inward and outward of said housing.

4. The electromagnetic lock device according to claim 3, wherein said recess of said latch is an annular recess.

5. The electromagnetic lock device according to claim 3, wherein said arm of said follower includes a head formed thereon and engaged in said recess of said latch.

6. The electromagnetic lock device according to claim 1 further comprising means for guiding said latch to move relative to said housing.

7. The electromagnetic lock device according to claim 6, wherein said guiding means includes a first flat surface formed in said latch, a cover secured to said housing and having a second flat surface formed therein and engaged with said first flat surface of said latch, said latch is prevented from rotating relative to said housing and said cover by the engagement between said first flat surface of said latch and said second flat surface of said cover.

8. The electromagnetic lock device according to claim 1, wherein said coupling means includes a link having a first end pivotally coupled to said spindle at a pivot axle and having a second end pivotally coupled to said first peg.

9. The electromagnetic lock device according to claim 1, wherein said spindle includes an extension extended therefrom.

10. The electromagnetic lock device according to claim 9 further comprising a casing secured in said housing, said coil being secured in said casing, said extension of said spindle including a diameter that is smaller than that of said spindle, said casing including a puncture formed therein for slidably receiving said spindle and including an aperture formed therein for slidably receiving said extension of said spindle, said aperture of said casing including a diameter that is smaller than that of said puncture of said casing.

11. The electromagnetic lock device according to claim 1 further comprising means for biasing said spindle toward said follower and to rotate said follower.

12. An electromagnetic lock device comprising:

a housing, a latch slidably received in said housing, a follower rotatably secured to said housing at a pivot pin, said follower including an arm extended therefrom and engaged with said latch for moving said latch inward and outward of said housing, said follower including a first peg extended therefrom, an electromagnetic member secured in said housing and including a coil, a spindle slidably engaged in and actuated by said coil, means for coupling said srindle to said first peg of said follower, said follower being rotated in a first direction to move said latch inward of said housing and being rotated in a reverse direction to move said latch outward of said housing, wherein said follower further includes a second peg extended therefrom, said coupling means couples said spindle to said second peg of said follower when said spindle is disengaged from said first peg, for allowing said follower to be rotated in said first direction to move said latch outward of said housing and to be rotated in the reverse direction to move said latch inward of said housing.

* * * * *